United States Patent [19]

Blessing

[11] 4,193,365

[45] Mar. 18, 1980

[54] TOGGLE CONTROLLED SERVO SYSTEM

[75] Inventor: Hubert Blessing, Dallas, Tex.

[73] Assignee: Levi Strauss & Co., San Francisco, Calif.

[21] Appl. No.: 966,195

[22] Filed: Dec. 4, 1978

[51] Int. Cl.[2] ..... F16H 21/26; F16H 33/00; D05B 21/00; D05B 27/14

[52] U.S. Cl. ..... 112/314; 74/520; 74/1.5; 185/40 R; 112/121.11

[58] Field of Search ..... 74/520, 1.5, 84 R, 88, 74/126, 128, 129, 142, 161, 526, 565; 185/38, 40 R, 40 B, 40 D, 40 H, DIG. 1; 58/116 R, 116 M; 112/314, 121.11

[56] References Cited

U.S. PATENT DOCUMENTS

| | | | |
|---|---|---|---|
| 3,522,742 | 8/1970 | Beherens | 74/142 |
| 3,650,229 | 3/1972 | Rovin | 112/121.11 |
| 3,732,949 | 5/1973 | Williams | 185/40 R |
| 4,019,447 | 4/1977 | Blessing et al. | 112/121.11 |
| 4,109,596 | 8/1978 | Blessing | 112/121.11 |

*Primary Examiner*—Werner H. Schroeder
*Assistant Examiner*—Andrew M. Falik
*Attorney, Agent, or Firm*—Limbach, Limbach & Sutton

[57] ABSTRACT

Digital control signals can be accepted and translated directly into low inertia, high torque intermittent rotary motion by this fast time response apparatus which comprises a low mass, rotatably mounted driving member, a source of driving torque such as a torque motor, a low rotary inertia torsion member which interconnects the driving member with the torque member to thereby apply torque to rotate the driving member, reciprocatably operated escapement means for controlling the rotation of the driving member, and a two-ended toggle linkage connected at one end in an operating relationship with the escapement means, and at the other end to a mechanism which supplies a reciprocating driving force. The toggle linkage has a normally flexible knee joint which can be selectively locked by electromechanical means to which the digital signals are supplied. When locked, the toggle linkage transmits a reciprocating driving force from one end, thereby triggering the escapement means so that the driving member is selectively, incrementally rotated under power from the torque motor through the torsion member.

9 Claims, 3 Drawing Figures

TOGGLE CONTROLLED SERVO SYSTEM

BACKGROUND OF THE INVENTION

The present invention relates to a mechanism for selectively producing fast response, intermittent rotary motion under the control of low power, digital signals and more particularly, for such apparatus when applied to manipulate a workpiece in a sewing machine.

In the field of automatically guiding fabric material as it is mechanically passed through a sewing machine, there are numerous prior art devices. Most of these devices are completely incapable of keeping up with present day high-speed sewing machines because of inertia problems. The actual manipulative device for the fabric workpieces must be capable of extremely fast acceleration and deceleration; therefore, it must be of a relatively low mass. In some prior art guiding devices, a rotatable guide is used ahead of the sewing machine needle. See, for example, U.S. Pat. No. 4,019,447 (Blessing, et al.) and U.S. Pat. No. 3,650,229 (Rovin). In the Rovin device, the guide is reciprocated up and down with the needle. Since the guide is relatively heavy, it can be appreciated that the acceleration and deceleration of the guide requires great force or a relatively low sewing rate. The device described in the Blessing patent does not utilize such reciprocation, but instead uses a low mass guide wheel. Unfortunately, this device does not have the feature that enables the fabric to be selectively manipulated either when the needle is down or when the needle is up. Manipulation of the fabric takes place regardless of the position of the needle.

Similar problems occur in other automated garment manufacturing devices where it is desired that some rotary motion take place in synchrony with a reciprocating motion, but that it only take place at intervals which can be selected under the control of low power digital, electrical signals. Heretofore, there have been no prior art devices which could provide such fast response control for relatively high powered rotary drives.

SUMMARY OF THE INVENTION

The disadvantages of prior art workpiece manipulation apparatus and other attempts to digitally control intermittent, high power and fast response rotary motion are overcome by the present invention which comprises a low mass, rotatably mounted driving member, a source of driving torque, a torsion member which interconnects the driving member with the torque source thereby to cause the driving member to be rotated, reciprocatably operated escapement means for controlling the rotation of the driving member, and a two-ended toggle linkage connected between a source of a reciprocating driving force and the escapement means. The toggle linkage has a normally flexible knee joint between its two ends and an electromechanical mechanism is provided for selectively locking the knee joint under the control of digital or analog electrical signals to cause the reciprocating driving force to be transmitted to trigger the escapment means whereby the source of driving torque causes the driving member to be intermittantly rotated through the torsion member.

In one embodiment, the means for locking the knee joint of the toggle linkage include an energizable coil and an armature which is movable with respect to the coil when the coil is unenergized and immovable with respect to the coil when the coil is energized by the application of digital signals and the armature is in contact with the coil. Either the armature of the coil is mounted stationary with respect to the toggle linkage knee joint and the other end of the armature or the coil is pivotably connected to the knee joint. When the coil is energized, the armature remains stationary, thereby locking the toggle linkage and constraining it from flexing outwardly. The reciprocating force which is applied to one end of the toggle linkage is thereby transmitted through the linkage to its other end and triggers the escapement means.

The driving member is ordinarily a low mass gear wheel and the torsion member is either a torsion bar or a coil spring. The source of driving torque is preferably an electrical, torque motor whose drive shaft is connected to the driving member through the torsion spring. The escapement means can be, for example, a clock type escape wheel having projecting teeth which are engaged by pallets on the end of a lever which is reciprocated selectively by the toggle linkage. This type of escapement is common in clock drives.

It is therefore an object of the present invention to provide a mechanism for selectively producing fast response, high power rotary motion under the direct control of digital signals.

It is another object of the present invention to translate low power digital signals into fast response positioning forces without reflection of the inertia of the positioned mass back to the digital control.

It is yet another object of the invention to provide a mechanism requiring little control power for selectively controlling rotary motion as a function of a reciprocating motion.

It is still a further object of the invention to provide a fast response X-Y forces for guiding a workpiece through a sewing machine in a synchronous relationship with the reciprocating sewing needle under the control of low power digital signals.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
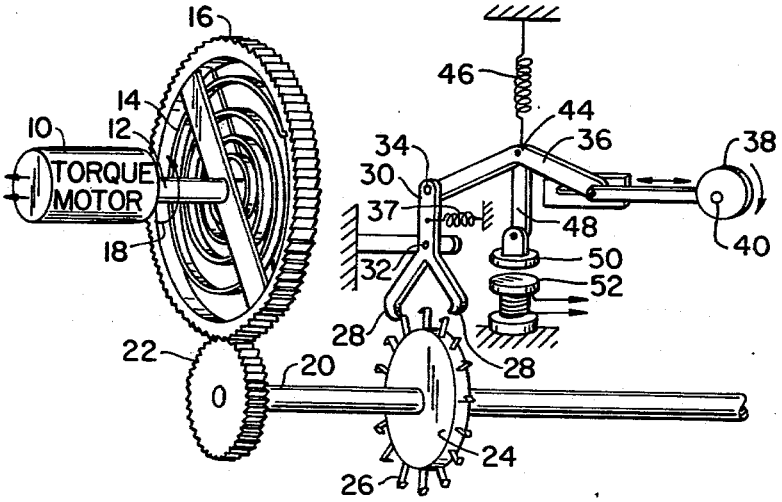
FIG. 1 is a diagrammatic illustration of a motion translating apparatus according to the invention.

Referring now more particular to FIG. 1, a source of torque in the form of an electrical, torque motor 10, having an output shaft 12, is connected to one end of a main coil spring 14 whose other end is connected to a driving gear 16. The driving gear 16 can be mounted to rotate freely about the end of the shaft 12 or it can have its own separate rotary mounting. In any case, the rotation of the shaft 12 in the direction indicated by the arrow 18 tends to coil the spring 14. As the spring 14 is coiled, it transmits the torque to the driving gear 16 and causes it to turn in the same direction. The driving gear 16 is connected to an output shaft 20 through a sprocket gear 22 which meshes with the drive gear 16.

An escapement wheel 24 is mounted on the output shaft 20 and has a plurality of circumferentially-spaced apart projecting teeth 26. These teeth are engaged by a pair of pallets 28 mounted at one end of a lever 30. The lever 30 is pivotably mounted at a pivot point 32 located between the pallets 28 and the opposite end 34 of the lever arm 30. The lever arm 30 is biased by a coil spring 37 to rotate in a clockwise direction about the pivot point 32 so as to engage the right hand-most pallet, as viewed in FIG. 1, with the teeth 26 on the escapement wheel 24. Whenever the lever 30 is forced to rotate in the counterclockwise direction, however, the right-hand pallet 28 disengages from one of the teeth 26 and the escapement wheel 24 rotates clockwise by a distance corresponding to one half of the spacing between teeth before the left-hand pallet engages one of the teeth.

Figure 2:
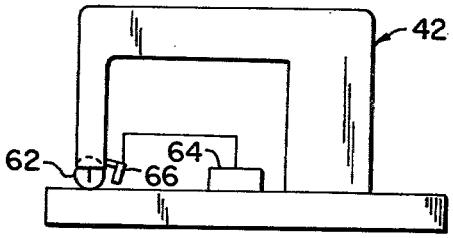
FIG. 2 is a diagrammatic illustration of a sewing machine in which the apparatus of the invention is intended to be incorporated.

One end of a two-ended toggle linkage 36 is connected to the end 34 of the lever 30. The other end of the toggle linkage is connected to be reciprocally driven in the direction of the toggle linkage's length by following an eccentric cam lobe 38 which is mounted to rotate with the crank shaft 40 of a sewing machine 42 (shown in FIG. 2). The toggle linkage 36 has a flexible knee joint 44 which is intermediate to its two ends. The knee joint 44 is biased by a coil spring 46 to bend when the two ends of the toggle linkage are pushed together by the reciprocating driving force from the cam 38. The knee joint 44 is connected by a link 48 to an armature plate 50.

Positioned opposite to the armature plate 50 is a solenoid coil 52. If the coil 52 is energized and the plate 50 is brought into contact with it, the plate will be magnetically attracted and held fast to the coil 52. This locks the knee joint 44 so that the toggle linkage no longer flexes. The reciprocating force applied from the cam 38 is then transmitted through the toggle linkage to the lever end 34 and causes the lever to rotate counter-clockwise, thereby allowing the escape wheel 24 to rotate in the clockwise direction. The rotation of the wheel 24, of course, allows the ouput shaft 20 to also rotate by the incremental space corresponding to one half of the space between a pair of teeth 26.

It must be appreciated that by the use of a relatively low power electrical signal, either digital or analog, to the coil 52, a high power reciprocating force is selectively "converted" into an incremental rotary force with little or no reflection of the inertia of the load attached to the output shaft 20 back to the circuit and mechanism which control the toggle linkage. The purpose of having the coil spring 14 is to allow an almost instantaneous response once the toggle knee is locked. All the elements such as the driving wheel 16, the gear 22 and the escapement wheel 24 have a relatively low mass compared to, for example, the torque motor 10. The coil spring 14 thus isolates these relatively low mass elements of the drive train from the heavier elements, thereby minimizing inertia problems.

The output shaft 20 can be used to drive, for example, the feed dogs of the sewing machine 42 to draw the fabric beneath the sewing needle and in synchrony with its up and down motion. A more important application of the invention, however, is to use the motion translater to drive guide wheels ahead of the needle to position the fabric workpieces as they are sewn. Such a guide wheel and a servo control system for operating it are described at length in the applicant's U.S. Pat. No. 4,019,447. As mentioned earlier in this application, however, the invention described in that patent is not capable of operating synchronously with the up and down motion of the sewing needle. Thus, guiding takes place whether or not the needle is inserted or withdrawn from the fabric workpiece and this limitation reduces the accuracy of the system in following the contour or other lines on the fabric workpiece.

Figure 3:
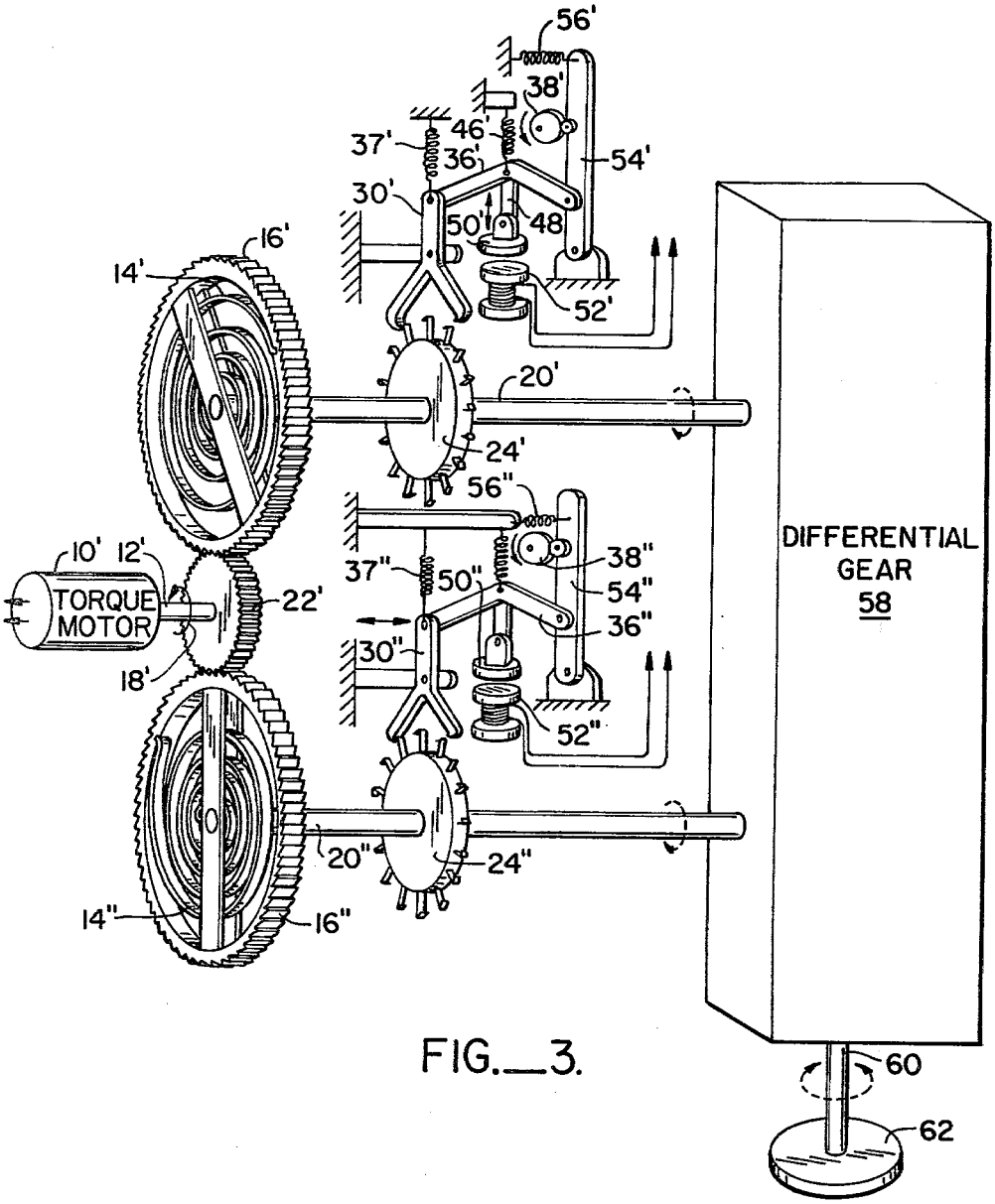
FIG. 3 is a diagrammatic illustration of the adaptation of the motion translating apparatus of the invention for use with the sewing machine depicted in FIG. 2.

Referring now more particularly to FIG. 3, a modification of the embodiment depicted in FIG. 1 to carry out this purpose is illustrated. The same elements which were described above in reference to the embodiment of FIG. 1 have been given corresponding reference numerals primed and double-primed. In essence, the system depicted in FIG. 1 has been doubled to obtain two output driving shafts 20' and 20''. The torque from the motor 10' is supplied by means of the sprocket gear 22' to two driving gears 16' and 16'', mounted on separate output driving shafts 20' and 20'' respectively. The ends of the toggle linkages 36' and 36'' are reciprocated by means of lever arms 54' and 54'' which are each pivotally mounted at one end and are biased by separate springs 56' and 56'' against the cam lobes 38' and 38''. The ends of the toggle linkages 36' and 36'' opposite from the levers 30' and 30'' are pivotally attached to the lever arms. It will be apparent that as the cam lobes 38' and 38'' rotate, the lever arms 54' and 54'' are reciprocated back and forth to transmit the reciprocating driving force to the toggle linkages 36' and 36''. The control of the rotation of the output drive shafts 20' and 20'' is substantially identical to that described in reference to the embodiment in FIG. 1, and therefore will not be described again.

The output shafts 20' and 20'' are supplied to the inputs of a differential gear box 58. The differential gear box 58 has an output shaft 60 which rotates in a direction and with a speed which is proportional to the difference of the rotational inputs by the shafts 20' and 20''. Thus, if the shaft 20'' is held stationary, and the shaft 20' is allowed to rotate, the output shaft 60 of the differential gear will rotate in one direction, for example, in the clockwise direction. Whereas, if the shaft 20' is held stationary and the shaft 20'' is allowed to rotate, the shaft 60 will rotate in the opposite direction. When both shafts 20' and 20'' are allowed to rotate at the same speed, or when both are held stationary, the shaft 60 is also stationary.

A guide wheel 62 is mounted on the end of the shaft 60. This guide wheel is of the type disclosed in the applicant's U.S. Pat. No. 4,019,447. The energization of the solenoids 52' and 52'' is under the control of a circuit 64 which is supplied with a signal from a photosensor 66 mounted just ahead of the sewing needle and to one side of it to follow the contour of the fabric workpiece in the manner described in the applicant's patent recited above. Since the details of such control circuits 64 and the positioning and use of the photosensor 66 are well known to those skilled in the art and are described in the applicant's U.S. Pat. No. 4,019,447, no further explanation of their workings will be given.

When the fabric workpiece contour moves out of range of the photosensor 66, the photosensor 66 sends an appropriate electrical signal to the control circuit 64 to energize the solenoid 52' to cause the output shaft 20' to supply a rotational input to the differential gear 58. Correspondingly, the output shaft 60 of the differential gear will cause the guide wheel 62 to rotate in a direction which drives the fabric workpiece back under the photocell 66 until the contour is again centered beneath the photocell 66 in servo fashion. It is to be understood that the guide wheel 62 rotates about an axis which lies in the same hypothetical plane as the direction of the fabric feed through the sewing machine. In the event that the fabric workpiece extends too far and completely blocks the photosensor 66, the solenoid 52" will be activated by the same process through the circuit 64 and the photosensor 66 to cause, in the same fashion, the guide wheel 62 to rotate in the opposite direction and to recenter the workpiece beneath the photocell 66.

The servo system depicted in FIG. 3 is somewhat similar in operation to that described in the applicant's U.S. Pat. No. 4,019,447. But it must be understood that the guide wheel 62 rotates incrementally, in synchrony with the rotation of the cam lobes 38' and 38" which, in turn, are operated in synchrony with the reciprocation of the sewing machine needle. Thus, the guide wheels can be arranged to only rotate when the needle is piercing the fabric, in one embodiment, or in another embodiment, can be designed to rotate only when the needle is not inserted in the fabric workpiece. This timing relationship is determined simply by the rotational position of the cam lobes 38' and 38" on the sewing machine drive shaft.

It will also be appreciated that the motion translating apparatus depicted in FIGS. 1 and 3 has wide application in the automated garment industry. Also, although a rotary guide has been illustrated, in other embodiments the guide could be of the X-Y positioning variety such as those disclosed in U.S. Pat. Nos. 3,385,244 (Ramsey, et. al.) or 3,742,879 (Schaefer, et. al.); with the device of the present invention simply being substituted for the X-Y positioning motors. Such a substitution would allow those devices to operate at far higher speeds and with low power controls since the massive inertia of the positioning frame would not be reflected back to the X-Y control circuit and mechanism.

Moreover the present invention is not even limited to guiding fabric workpieces beneath the sewing needle. The apparatus can easily be adapted to other types of guiding mechanisms for use in automated manufacturing machines in general, and in powering transport apparatus for workpieces and processing them through such machines.

The terms and expressions which have been employed here are used as terms of description and not of limitations, and there is no intention, in the use of such terms and expression of excluding equivalents of the features shown and described, or portions thereof, it being recognized that various modifications are possible within the scope of the invention claimed.

What it claimed is:

1. Apparatus for selectively supplying intermittent rotary motion under the control of electrical signals from an external source, the apparatus comprising a source of driving torque, a torsion member, having relatively low rotational inertia, which interconnects the driving member with the torque source to thereby apply torque to the driving member in the direction of rotation of the driving member, reciprocatably operating escapement means for controlling rotation of the driving member, a two-ended toggle linkage connected at one end in an operating relationship with the escapement means, the toggle linkage having a normally flexible knee joint between the two ends, means for supplying a constantly reciprocating driving force to the other end of the toggle linkage, and electromechanical means for receiving electrical control signals and being energized by them to lock the knee joint so that the driving force is transmitted to trigger the escapement means when the knee joint is locked and is diverted into flexing the knee joint when the knee joint is unlocked, whereby the driving member is selectively rotated under power from the driving torque source through the torsion member under the control of the electrical signals from the external source.

2. Apparatus as recited in claim 1, wherein the electromechanical means for selectively locking the knee joint comprise an armature, a selectively energizable coil, the armature being movable with respect to the coil when the coil is unenergized and being immovable with respect to the coil when the coil is energized and the armature is in contact with the coil, and with either the armature or the coil being mounted stationary with respect to the toggle knee joint and the other being connected to the toggle knee joint, whereby upon energization of the coil and contacting of the armature with the coil, the knee joint of the toggle linkage is constrained from flexing.

3. Apparatus as recited in claim 1, wherein the driving member is a gear wheel, the torsion member is a coil spring, the driving torque source is an electrical, torque motor having a drive shaft, the coil spring is connected at one end to the motor shaft, and at its other end to the gear wheel, and the escapement means are connected to the gear wheel to allow it to rotate whenever the escapement means are triggered by the toggle linkage.

4. Apparatus as recited in claim 1, wherein the means for supplying a constantly reciprocating driving force include a sewing machine having a reciprocating drive for a sewing needle and further comprising means for manipulating sewing workpieces as they are sewn by the machine, the manipulating means being connected to be driven by the driving member, whereby the manipulating means are selectively driven in synchrony with the sewing machine needle under the control of the electrical signals.

5. Apparatus for guiding a workpiece in an automated machine of the type having a reciprocating operating element, the guiding apparatus comprising a low mass, rotatably mounted driving member, a source of driving torque, a torsion member interconnecting the driving torque source to the driving member, whereby torque is applied to it, reciprocatably operated escapement means for controlling rotation of the driving member, a two-ended toggle linkage connected at one end in an operating relationship with the escapement means, the toggle linkage having a normally flexible knee joint between the two ends, one of the ends being connected to the reciprocating operating element so as to be reciprocated by it, and electromechanical means for selectively locking the knee joint so that both ends of the linkage are reciprocated by the operating element and the escapement means are triggered with each reciprocation of the linkage only when the knee joint is locked, whereby the driving member is selectively rotated by the torque source in synchrony with the reciprocations of the operating element, a movable workpiece guide connected to the driving member so as to be driven by its rotations and thereby move the workpiece, a sensor for detecting the position of the workpiece relative to a predetermined position and for producing a control signal representative of the workpiece's deviation from the predetermined position, and servo-control means supplied with the sensor control signal for activating the electro-mechanical knee joint locking means in response to the sensor control signal whereby the guide is caused to move and reposition the workpiece to the predetermined position.

6. Apparatus for selectively translating reciprocating motion into intermittent rotary motion, comprising a source of driving torque, a torsion member interconnecting the driving member with the torque source to thereby apply torque to the driving member in the direction of rotation of the driving member, reciprocatably operating escapement means for controlling rotation of the driving member, a two-ended toggle linkage connected at one end in an operating relationship with the escapement means, the toggle linkage having a normally flexible knee joint between the two ends, means for supplying a constantly reciprocating driving force to the other end of the toggle linkage, and means for selectively locking the knee joint so that the driving force is transmitted to trigger the escapement means when the knee joint is locked and is diverted into flexing the knee joint when the knee joint is unlocked, whereby the driving member is selectively rotated under power from the driving torque source through the torsion member in synchrony with the reciprocating driving force.

7. Reciprocating motion to rotary motion translating means as recited in claim 6, wherein the means for selectively locking the knee joint comprise electromechanical means including an armature, a selectively energizable coil, the armature being movable with respect to the coil when the coil is unenergized and being immovable with respect to the coil when the coil is energized and the armature is in contact with the coil, and with either the armature or the coil being mounted stationary with respect to the toggle knee joint and the other being connected to the toggle knee joint, whereby upon energization of the coil and contacting of the armature with the coil, the knee joint of the toggle linkage is constrained from flexing.

8. Reciprocating motion to rotary motion translating means as recited in claim 6, wherein the driving member is a gear wheel, the torsion member is a coil spring, the driving torque source is an electrical, torque motor having a drive shaft, the coil spring is connected at one end to the motor shaft and at its other end to the gear wheel, and the escapement means are connected to the gear wheel to allow it to rotate whenever the escapement means are triggered by the toggle linkage.

9. Reciprocating motion to rotary motion translating means as recited in claim 6, wherein the means for supplying a constantly reciprocating driving force include a sewing machine having a reciprocating drive for a sewing needle and further comprising means for manipulating sewing workpieces as they are sewn by the machine, the manipulating means being connected to be driven by the driving member, whereby the manipulating means are selectively driven in synchrony with the sewing machine needle.

* * * * *